US008794453B2

(12) United States Patent
Kologe

(10) Patent No.: US 8,794,453 B2
(45) **Date of Patent: *Aug. 5, 2014**

(54) SECURITY HOOK FOR PRODUCT DISPLAY

(75) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 366 days.

This patent is subject to a terminal disclaimer.

(21) Appl. No.: 13/281,800

(22) Filed: Oct. 26, 2011

(65) Prior Publication Data

US 2013/0105419 A1 May 2, 2013

(51) Int. Cl.
*A47F 7/024* (2006.01)
*A47F 5/08* (2006.01)

(52) U.S. Cl.
CPC ..... *A47F 5/0861* (2013.01)
USPC ..... 211/7; 211/57.1; 211/59.1

(58) Field of Classification Search
CPC ..... A47F 5/00; A47F 5/01; A47F 5/02; A47F 5/025; A47F 5/03; A47F 5/04; A47F 5/05; A47F 5/06; A47F 5/08; A47F 7/00; A47F 7/02; A47F 7/024; A47F 5/0861; A47F 7/143; A47F 7/285
USPC ..... 211/59.1, 4, 7, 57.1
See application file for complete search history.

(56) References Cited

U.S. PATENT DOCUMENTS 4,289,242 A * 9/1981 Kenyon ..... 211/4
4,476,983 A * 10/1984 Fast ..... 211/57.1
4,497,464 A * 2/1985 Fast ..... 248/220.31
5,038,944 A * 8/1991 Sorensen et al. ..... 211/59.1
5,375,725 A * 12/1994 Rosenthal ..... 211/59.1
5,597,150 A * 1/1997 Stein et al. ..... 248/551
6,474,478 B1 * 11/2002 Huehner et al. ..... 211/4
6,622,979 B2 * 9/2003 Valiulis ..... 248/220.42
6,659,291 B2 * 12/2003 Huehner et al. ..... 211/4
6,957,555 B1 * 10/2005 Nagel et al. ..... 70/57.1
7,007,810 B2 * 3/2006 Huehner et al. ..... 211/57.1
7,131,542 B2 * 11/2006 Sedon et al. ..... 211/59.1
7,137,513 B2 * 11/2006 Sedon et al. ..... 211/59.1
7,178,678 B2 * 2/2007 Mansfield et al. ..... 211/7
7,197,902 B1 * 4/2007 Barkdoll ..... 70/57.1
7,392,673 B2 * 7/2008 Fawcett et al. ..... 70/14
7,703,308 B2 * 4/2010 Nagelski ..... 70/57.1
7,708,153 B2 * 5/2010 Mansfield et al. ..... 211/7
7,743,931 B2 * 6/2010 Barkdoll ..... 211/7
8,286,454 B2 * 10/2012 Richardson et al. ..... 70/14
8,307,995 B2 * 11/2012 Surma et al. ..... 211/7
8,376,150 B2 * 2/2013 Surma et al. ..... 211/7
2005/0029205 A1 * 2/2005 Mansfield et al. ..... 211/7

(Continued)

*Primary Examiner* — Michael Safavi
(74) *Attorney, Agent, or Firm* — St. Onge Steward Johnston & Reens LLC

(57) ABSTRACT

A security product display hook assembly comprising a unique form of product display hook, in combination with a security lock, providing optional levels of product security and customer convenience. The display hook has a merchandise supporting arm formed with a back section, an intermediate section and a front section. The intermediate section is of sharply irregular configuration to allow, but inhibit, product removal, while effectively preventing mass product removal often attempted by shoplifters. The locking device is positionable in front of or directly behind the intermediate section to provide the highest security, with all products locked or an intermediate level, with a portion of the products locked. The locking device can also be positioned at the back of the back section such that all products are unlocked and available for customer selection.

7 Claims, 3 Drawing Sheets

(56) References Cited

U.S. PATENT DOCUMENTS

| | | | | |
|---|---|---|---|---|
| 2006/0157431 | A1* | 7/2006 | Nagelski et al. | 211/54.1 |
| 2007/0062890 | A1* | 3/2007 | Nagelski et al. | 211/57.1 |
| 2007/0119796 | A1* | 5/2007 | Barkdoll | 211/54.1 |
| 2007/0119797 | A1* | 5/2007 | Mansfield et al. | 211/54.1 |
| 2008/0209960 | A1* | 9/2008 | Nagelski | 70/57.1 |
| 2009/0057244 | A1* | 3/2009 | Conti et al. | 211/7 |
| 2009/0095695 | A1* | 4/2009 | Moock et al. | 211/57.1 |
| 2009/0184129 | A1* | 7/2009 | Vlastakis et al. | 221/15 |
| 2010/0199538 | A1* | 8/2010 | Roberts et al. | 40/642.01 |
| 2010/0206825 | A1* | 8/2010 | Johnston et al. | 211/59.2 |
| 2010/0223965 | A1* | 9/2010 | Richardson et al. | 70/58 |
| 2010/0300992 | A1* | 12/2010 | Surma et al. | 211/7 |
| 2011/0036789 | A1* | 2/2011 | Richardson et al. | 211/1.57 |
| 2012/0097622 | A1* | 4/2012 | Surma et al. | 211/7 |

* cited by examiner

SECURITY HOOK FOR PRODUCT DISPLAY

FIELD OF THE INVENTION

The present invention relates to product display hooks for suspending and displaying merchandise, and more particularly to such display hooks provided with security features to limit or prevent product theft.

BACKGROUND OF THE INVENTION

Carded and packaged items of merchandise are commonly displayed on peg hooks and the like, referred to herein as product display hooks, which extend from metal bars, perforated panels, slat boards and the like. A number of like product items can be suspended and displayed from a single hook, and a large number of hooks can be mounted on a single panel, which makes such hooks a convenient and attractive way for storekeepers to offer their merchandise. An advantageous form of display hook is formed of wire and is provided with upper and lower outwardly extending arms. The upper arm mounts a label holder for pricing and other product information, while the lower arm receives the merchandise, typically mounted on cards with openings to receive the projecting wire of the display hook.

A potential downside to this manner of display, however, is that the merchandise so displayed can be targeted by shoplifters. Particularly when the displayed merchandise is of an expensive nature (packages of several dry cell batteries is one example) shoplifting can be a problem and a source of considerable economic loss to the shopkeeper.

Various concepts have been proposed to minimize product "shrinkage" from theft. Among these are specially designed product display hooks incorporating built-in locking arrangements. These tend to be expensive and also can make for a somewhat unattractive display. One widely used system is based on U.S. Pat. No. 6,957,555, which is directed to a special locking device that can be retrofitted onto a standard product display hook and prevents the unauthorized removal of merchandise from the hook. This product is made available by the assignee of this application under the trademark "ScanLock" and provides a convenient and economical means for preventing theft. The ScanLock device can be easily applied to and removed from standard hooks and thus provides the storekeeper with a great deal of flexibility in the display of merchandise. When a particular hook is to be loaded with expensive merchandise, the storekeeper can simultaneously install a ScanLock device, which requires a store clerk to attend the removal of the product. The locking device can later be quickly uninstalled from a hook if it is decided to display lower cost merchandise less subject to theft.

Unfortunately, the existing anti-theft solutions are in the nature of one-size-fits-all, in that either all of the merchandise on the hook is locked, or none of it is locked. However, not all store locations are subject to the same level of shoplifting risk, and for locations in lower risk areas storekeepers are interested in balancing risk of loss with shopper convenience. An improved system is needed, and is provided by this invention, whereby a storekeeper can elect to display a portion of the merchandise on a display hook in a locked and secure manner, while at the same time displaying one or a few items at the front, unlocked, for convenient access customers. Merchandise displayed in this manner is not highly attractive to shoplifters because of the limited number of unsecured items available, while providing normal convenience to the regular shopper.

SUMMARY OF THE INVENTION

The invention is directed to a unique and advantageous form of product display hook which is combined with a ScanLock device or other suitable form of locking device and which is so constructed that the product supporting lower arm comprises distinct back, intermediate and front sections. Merchandise can be placed and distributed on some or all of these distinct sections, and the locking device can be located on the front section, just behind the intermediate section, or at the back of the back section, depending on the levels of security and customer convenience deemed appropriate by the storekeeper. The intermediate section is of sharply irregular configuration, such that merchandise can be removed therefrom on a one-at-a-time basis, but not several at a time, to make the display less attractive to shoplifters.

DETAILED DESCRIPTION OF THE INVENTION

Figure 1:
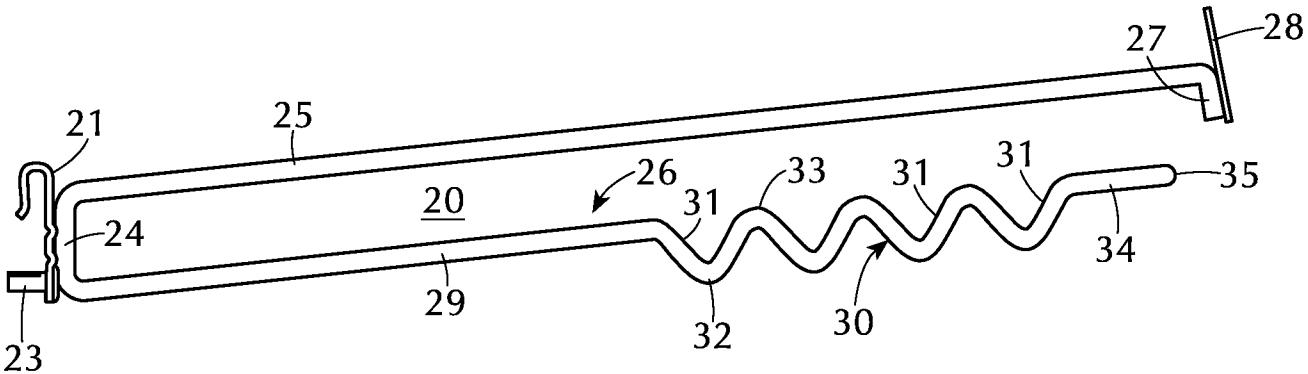
FIG. 1 is a side elevational view of a product display hook incorporating features of the invention.
Figure 2:
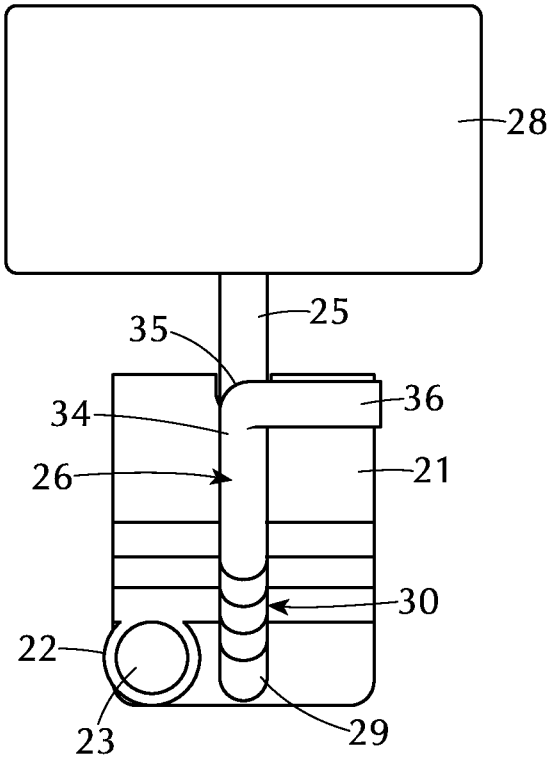
FIG. 2 is a front elevational view of the display hook of FIG. 1

Referring to the drawings, the reference numeral 20 designates generally a display hook according to the invention. The display hook comprises a base plate 21, which can be of a known, conventional type, adapted to be supported on a display wall (not shown) of conventional type. The illustrated base plate is intended to be suspended on a metal cross bar (not shown). However, the base plate may also be configured for mounting on a perforated panel, slat board or other display panel arrangement. The illustrated base plate, designed for support on a metal cross bar, advantageously is provided with a through opening 22 at the bottom, for the reception of a locking pin 23 which extends under the bar and inhibits lifting of the hook off of the cross bar by unauthorized parties.

The main portion of the display hook 20 is formed of a continuous length of wire and comprises a vertical portion 24, which is welded or otherwise fixed to the base plate 21, an outwardly extending upper arm 25 and an outwardly extending lower arm 26 which extends generally parallel to but spaced below the upper arm, as shown in FIG. 1. In the illustrated form of the invention, the upper arm 25 of formed with a downwardly extending portion 27 at its forward extremity, and a label mounting plate 28 is welded to the portion 27. The mounting plate provides a fixed surface for securing labels with pricing and other product information. Alternative label mounting arrangements may be employed, such as pivoting label holders supported on a cross bar at the end of the upper arm 25. Whatever arrangement is provided for the display of labels will also serve the functions of protecting the outer end of the arm 25 and of forming a positive stop means at the outer end of the arm.

In accordance with an aspect of the invention, the lower arm 26 of the display hook is formed with three separate sections. A first or back section 29 extends from the base plate 21 for approximately one-half the length of the lower arm, and is of relatively straight configuration such that carded or other merchandise suspended thereon can easily slide along the first section. A second or intermediate section 30 is integrally joined with the first section 29 and extends to a position a short distance from the end extremity of the lower arm 26. The intermediate section 30 is configured in a sharply angular form. In the illustrated example, the angular form consists of a plurality of connected V-shaped segments 31. The V-shaped segments 31 preferably are formed with sharp connecting curves 32, 33 at the bottom and top. In the illustrated example, the intermediate section 30 is formed with four sets of connected V-shaped segments 31. In the illustrated and preferred embodiment of the invention, the V-shaped segments 31 are disposed mostly below an axis defined by the straight back section 29.

Preferably, the V-shaped segments are aligned in a common vertical plane with the upper arm 25. The arrangement is such that, to remove an item of carded merchandise from the back section 29 of the lower hook, the item has to be moved vertically upward and downward four times in order for it to pass over the intermediate section 30 of the lower arm. This slows down the removal of the merchandise item and thus inhibits a "quick strike" action of a shoplifter. Moreover, the several connected V-shaped sections make it next to impossible for a shoplifter to strip a display hook of its entire inventory.

In the illustrated embodiment of the invention, the lower arm 26 also includes a forward section 34 joined integrally with the intermediate section 30 and extending forwardly therefrom to a point a short distance behind the label mounting plate 28. The forward section 34 desirably is straight and substantially coaxial with the back section 29. At its forward extremity 35, the forward section 34 has a lateral extension 36 that serves as a position stop for an item of merchandise at a forwardmost position on the lower arm while enabling the merchandise to be removed from the hook by a lateral motion along the extension.

Pursuant to an aspect of the invention, the illustrated display hook 20 is advantageously used in combination with a locking device 40, which preferably but not necessarily is of the type which forms the subject matter of the before mentioned U.S. Pat. No. 6,957,555, the subject matter of which is incorporated herein by reference. The described locking device comprises a body 41 containing a rotor element 42 that can be rotated between "lock" and "unlock" positions by an insertable/removable key 43. The upper portion 44 of the lock body 41 has a recess 45 for engaging the upper arm 25 of the hook, and a retaining plate 46 which secures the lock body to the upper arm 25 while allowing it to rotate about the arm.

Figure 3:
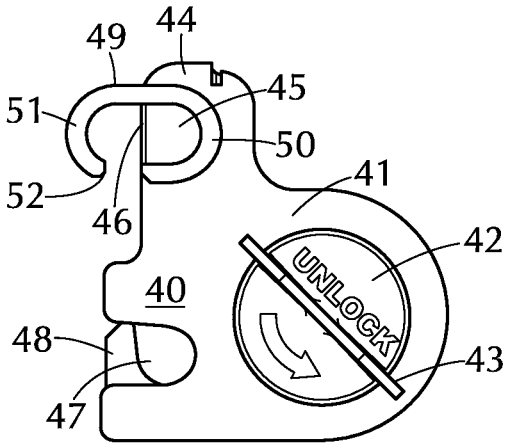
FIG. 3 is a front elevational view of an advantageous form of locking device utilized in combination with the display hook of FIG. 1.

As shown in FIG. 3, the lock body 41 includes a second recess 47 positioned to receive the back or forward sections 29, 34 of the hook 20 when the lock body is rotated to a position in which the lower recess 47 is directly below the upper recess 45. The lock rotor 42 includes a locking arm 48 which, when the rotor is in its "lock" position, closes off the recess 47 and secures the lock body 41 to the lower arm 26 of the display hook. When the lock body is secured to the lower arm, any merchandise suspended on the lower arm and positioned behind the lock body will be locked on the display hook. The lock can be released by rotation of the rotor to open the recess 47 and allow the lock body to be rotated out of the way. This, of course, requires the presence of an authorized person with a key.

Figure 4:
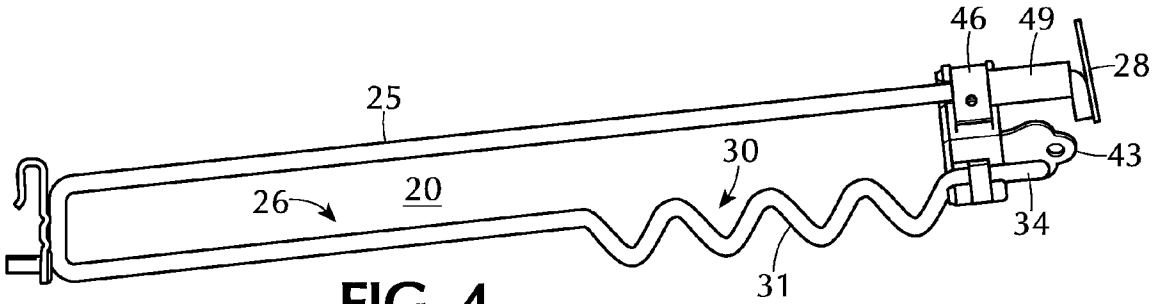
FIG. 4-6 are side elevational views of the display hook of FIG. 1, shown with the locking device of FIG. 3 in various alternative positions, providing various degrees of security according to the desires of the storekeeper.

In the form of locking device 40 shown, the upper portion of the lock body is advantageously formed with an integral tubular extension 49. One portion 50 of the extension is aligned with the upper recess 45 and is arranged to receive a portion of the upper arm 25 when the lock body is mounted on the arm. A second portion 51 of the extension is positioned laterally beyond the open side of the recess 45 and has a downwardly opening slot 52. The slot 52 can be flexed open to fit over the upper arm 25 to enable the lock body to be installed thereon. The length of the tubular extension is such as to define a desired forwardmost position of the lock body 41 at a distance back of the label mounting plate 28, as shown in FIG. 4, whereby the lock body engages the lower arm 26 directly in front of the V-shaped sections 31 of the lower arm intermediate section 30.

Figure 5:
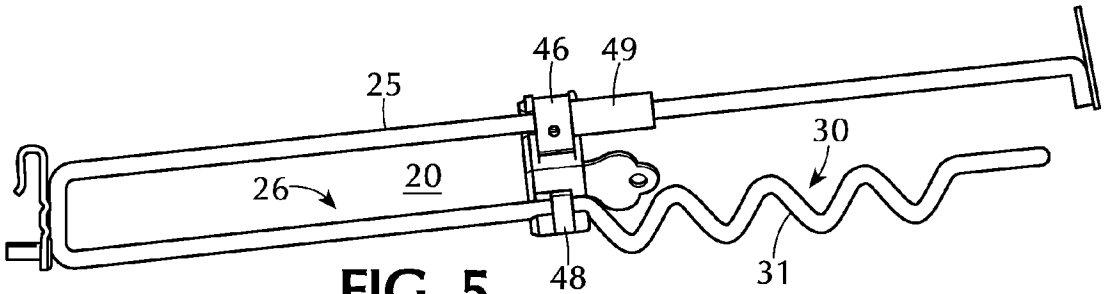
Figure 6:
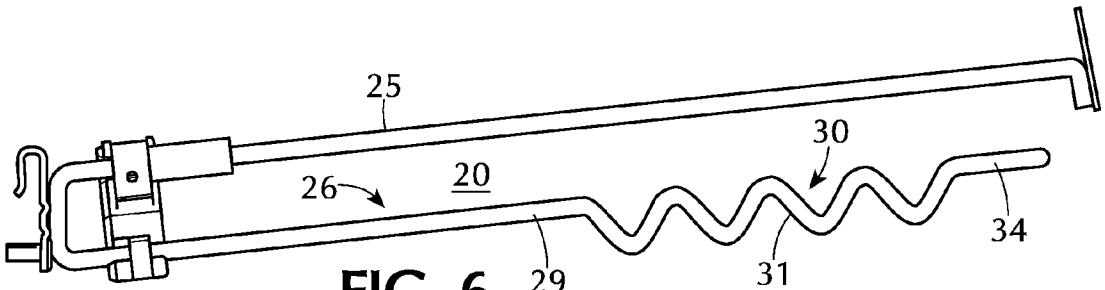

In accordance with an aspect of the invention, the locking device 40 can be located in various positions on the display hook 20, as determined by the storekeeper to be consistent with the level of shoplifting threat that exists at the particular store location. In an upscale area, in which shoplifting is a negligible threat, and/or where the value of the displayed merchandise is relatively low, the storekeeper has the option of locating the locking device 40 at a backmost position on the back section 29 of the hook, as shown in FIG. 6, such that none of the displayed merchandise is locked and the customers may freely serve themselves in the selection of merchandise. Should circumstances indicate a moderate, but not high, level of threat, the storekeeper may opt to position the locking device at the forward end of the back section 29, as shown in FIG. 5. In this position, all merchandise items supported on the back section 29 will be locked and can be removed only by or with the attendance of a authorized store person with a key. In this configuration, however, the storekeeper can place one or several product items in front of the lock, hanging in the V-shaped sections 31 of the intermediate section 30 and/or on the forward section 34. And items on the forward section 34 will, of course be easily removable, and items on the intermediate section will be removable, but less easily.

Should the storekeeper deem the threat of loss high or very high, he or she has the further option of positioning the locking device 40 on the front section 34 of the lower arm 26. In this lock position, the storekeeper can place all of the merchandise behind the lock, or optionally leave an item suspended from the section 34 in front of the lock. When the locking device is positioned on the forward section 34, the lateral extension 36 of the forward section serves as a positive stop and thus will prevent the lower portion of the locking device, when locked, from being pulled forwardly over the end of the forward section to release merchandise.

A storekeeper's objective is always to sell as much merchandise as possible, consistent with holding "shrinkage" from shoplifting at tolerable levels. The invention gives the storekeeper unique tools to optimize the balance of customer accommodation and freedom to chose, with maintaining a desirable level of control over product loss, through the combination of an advantageous display hook configuration in conjunction with the use of a positionable locking device. This enables as much merchandise as the store owner is willing to risk, given the store location and surrounding circumstances, to be made directly accessible to the customer, with the option to require the presence of store personnel to release any greater amount of the displayed product. The storekeeper's options apply to both the character of the surrounding neighborhood and to the value of the displayed merchandise, and both can be evaluated in the determination of an optimal location for placement of the locking device on a particular merchandise hook.

It will be understood, of course, that the embodiments of the invention herein specifically disclosed are intended to be representative of the invention but not limiting as to the manner in which it may be carried out.

What is claimed is:

1. A security product display hook assembly for the display and controlled dispensing of product items, which comprises a display hook comprising a base for mounting the hook on a display panel, and upper and lower arms extending outwardly from said base in vertically spaced relation, said upper arm being of generally straight configuration and mounting a label holder at a forward extremity of said arm, said lower arm having a generally straight back section adjacent said base adapted for the slidable reception of product items, an intermediate section of sharply irregular configuration for accommodating and causing the obstructed forward movement of product items, and a forward section for removal and optional display of product items, and a locking device having an upper portion non-removably attached to said upper arm for slideable movement on said upper arm and a lower portion controllably removably attached to said lower arm in selected positions on said back section and on said forward section to prevent unauthorized removal of product items positioned behind said locking device, said forward section of said lower arm having a length greater than a thickness of said locking device such that a portion of said forward section extends forward of said locking device, when said locking device is located on said forward section, a sufficient distance to enable a product item to be displayed on said forward section in front of said locking device, said intermediate section of said lower arm comprising a series of at least two sets of angularly connected alternately downwardly and upwardly disposed wire sections joined together and disposed substantially in a common plane with said upper arm, whereby a series of downward and upward movements of a product item is required in order to transfer the product item from said inner section to said outer section of said lower arm, bottom portions of said series of downwardly and upwardly disposed sections forming a plurality of spaced apart display positions within said intermediate section for the display of product items, said upper arm having an obstruction-forming element engageable with said locking device to limit forward movement of said locking device and define a forward-most position of said locking device to a rear portion of said forward section, to accommodate the display of a product item on said forward section in front of said locking device, the forward section of said lower arm having a retaining element at its forward extremity to retain a product item thereon while permitting intended removal of the product item when desired.

2. A security product display hook assembly according to claim 1, wherein said retaining element comprises an end portion of said lower arm, extending horizontally at right angles to said forward section.

3. A security product display hook assembly according to claim 1, wherein said alternately downwardly and upwardly disposed wire sections are joined at bottom portions thereof at acute angles to form a plurality of V-shaped product display positions.

4. A security product display hook assembly according to claim 3, wherein said generally straight back section defines an axis and said V-shaped product display positions are below said axis.

5. A security product display hook assembly according to claim 1, wherein said locking device has an extension element on an upper portion thereof extending forwardly therefrom toward and engageable with said obstruction-forming element to locate a lower portion of said locking device in a position on said forward section and spaced rearward of said retaining element to accommodate a product item displayed on said forward section in front of said locking device.

6. A security product display hook assembly according to claim 5, wherein said obstruction-forming element is said label holder mounted at a forward extremity of said upper arm in a position forward of a forward extremity of said lower arm.

7. A security product display hook assembly according to claim 1, wherein said locking device has a first operative position with said lower lock portion secured to said forward section of said lower arm, a second operative position with said lower lock portion secured to the back section of said lower arm, at a forward position on said back section, and a third operative position with said lower lock portion secured on said back section, at a rearward position on said back section.

* * * * *